United States Patent [19]

James et al.

[11] 4,062,739

[45] Dec. 13, 1977

[54] ELECTROPLATING ZINC OR CADMIUM AND ADDITIVE COMPOSITION THEREFOR

[75] Inventors: Barrie Sidney James, Kingswinford; Apolonious Wyszynski, Sutton Coldfield, both of England

[73] Assignee: W. Canning Limited, London, England

[21] Appl. No.: 687,455

[22] Filed: May 18, 1976

Related U.S. Application Data

[62] Division of Ser. No. 457,611, April 3, 1974, abandoned.

[30] Foreign Application Priority Data

Apr. 4, 1973 United Kingdom ..... 16172/73

[51] Int. Cl.[2] ..... C25D 3/24; C25D 3/28

[52] U.S. Cl. ..... 204/50 Y; 204/DIG. 2; 204/55 Y; 252/182

[58] Field of Search ..... 204/50 R, 50 Y, 55 R, 204/55 Y, DIG. 2; 252/182

[56] References Cited

U.S. PATENT DOCUMENTS

| | | | |
|---|---|---|---|
| 1,564,414 | 12/1925 | Hoff | 204/50 Y |
| 2,885,330 | 5/1959 | Levy | 204/50 Y |
| 3,884,774 | 5/1975 | Kessler | 204/55 Y |

*Primary Examiner*—G. L. Kaplan
*Attorney, Agent, or Firm*—Marn & Jangarathis

[57] ABSTRACT

Zinc and cadmium are electrodeposited in the presence of the more or less complex mixture present after reacting (a) a compound containing a pyridine nucleus, especially a 3-substituted pyridine and (b) a compound containing an oxirane ring such as an alkylene or arylene oxide, and yield a bright electrodeposit.

13 Claims, No Drawings

ELECTROPLATING ZINC OR CADMIUM AND ADDITIVE COMPOSITION THEREFOR

This is a division of application Ser. No. 457,611, filed Apr. 3, 1974, now abandoned.

This invention relates to a novel mixture produced by reaction of a pyridine compound and an oxirane compound, and to its use in the electrodeposition of zinc or cadmium from an alkaline cyanide bath to produce lustrous and bright deposits.

The electrodeposition of zinc and cadmium from alkaline cyanide solutions is widely used to produce coatings which protect iron and steel from corrosion. In theory this takes place by sacrificial galvanic protection but in practice rapid corrosion does not occur, since the cadmium or zinc (unless exposed to exceptionally humid atmospheric conditions) develops upon its surface a protective film which resists further attack.

Such natural films do lead to a loss of surface lustre and so as to prevent this tarnishing, artificial films can be produced on the zinc or cadmium electroplate as an additional measure of protection, and to enable articles to withstand conditions of high humidity, by "passivating" it by immersion in suitable acid solutions. The addition of chromate or dichromate to these solutions provides tougher films, with increased corrosion protection and improved abrasion resistance, whose colour varies from blue to yellow to bronze depending on their thickness.

An objective of the present invention is to increase the brightness of the electrodeposits obtainable over a wide range of current densities from zinc and cadmium cyanide solutions and so give them more appeal when used as a decorative finish. Brightness is a difficult term to define, since it is a property of the plate which can only be approximately measured on instruments. The only real criterion is inspection by the human eye, because the incident light is reflected in two ways, namely mirror-like reflection and diffuse reflection. Perfect mirror reflection is never achieved in practice, and some of the light is reflected diffusely to make the surface appear "cloudy" or "hazy". For anti-glare application this diffuse reflection is more desirable but for most decorative applications mirror-like reflection is more pleasing.

The present invention sets out to provide additives for zinc and cadmium plating baths which increase the extent of mirror-like reflection obtained from the zinc or cadmium plated article, particularly in recesses and other portions where the current densities are low.

In one aspect therefore the present invention consists in that mixture remaining after the reaction in the presence of water and/or of at least one short-chain aliphatic mono-or polyhydroxy alcohol of (a) a compound containing a pyridine nucleus and (b) a compound containing an oxirane ring.

The compound containing the pyridine nucleus is preferably a pyridine substituted by one or more or combinations of the following groups:

i. Alkyl
ii. Nitrile
iii Hydroxyl
iv. Carboxylic acid or salt of a carboxylic acid — $COO^- X^-$ where X is a metal of groups I or II (e.g. Na) or an ammonium or amine group, v. Amide,

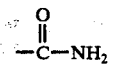

or substituted amide containing the group

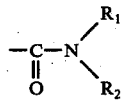

where $R_1$ and and $R_2$ are the same or different and may be alkyl or aryl.

vi. Ester containing the group COOR where R may be alkyl or aryl.

Specific examles of compounds containing these groups are (i) 2,6-lutidine (ii) 3-cyano-pyridine (iii) 3-hydroxy pyridine (iv) nicotinic acid, 2-picolinic acid, (v) nicotinamide or N,N-diethyl nicotinamide (vi) methyl nicotinate, benzyl nicotinate, phenyl nicotinate.

The pyridine is preferably substituted in the 3-position and the compounds found particularly useful are nicotinamide, nicotinonitrile, nicotinic acid and methyl nicotinate.

The oxirane compound is usually of the general formula

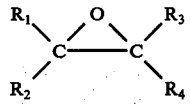

wherein the various groups $R_1$, $R_2$, $R_3$ and $R_4$, which may be the same or different, comprise hydrogen, alkyl, alkenyl, alkynyl, aryl, alkaryl, aralkyl, or alkyl (or alkenyl) with an ether linkage. Examples of suitable compounds are ethylene oxide, propylene oxide, butylene oxide, styrene oxide, butyl glycidyl ether, alkyl glycidyl ether, or like compounds, those specified being by way of example only.

According to the present invention such mixtures themselves have utility and separation and purification of individual components is unnecessary.

Reaction is preferably effected at molar ratios of 1:0.5 to 1:2 referring to pyridine compound and oxirane compound respectively. Preferably, ratios from 1:0.8 to 1:1.25 are used, although for nicotinamide itself a preferred ratio is 1:1.

The amount of water used is not critical for the outcome of the reaction and although a vast dilution may prevent the reaction from proceeding, some excess water is not detrimental and may be necessary, depending upon the solubility of the pyridine compound. For instance, nicotinamide can conveniently be dissolved in twice its weight of water, but nicotinic acid itself cannot be so dissolved without heating. This in some cases may be undesirable since it affects the composition of the resulting mixture; in fact cooling during the reaction is advantageous to keep the temperature down and prevent inter alia volatilisation of the more volatile alkylene oxides. In practice, it will be found convenient to add sodium hydroxide to the nicotinic acid to form completely or in part the sodium salt which can be dissolved with no, or minimal, heating.

The reaction is most conveniently performed by dissolving the pyridine compound in water, with heating and stirring, then heating or cooling to a convenient temperature (which depends on the alkylene oxide to be employed) adding the alkylene oxide to this mixture and either leaving the solution to react by itself if the alkylene oxide is volatile ( as in the case of propylene oxide) or refluxing the solution (as in the case of styrene oxide). The rate of reaction may be followed by monitoring the increase in pH, or rise in temperature if no external heating is used.

The term 'mixture remaining after reaction' is intended to cover a mixture containing primary reaction product, as discussed below, and water, together with some or all of the following components:

i. unreacted starting material ii. byproducts of reaction, whether simple, complex, polymerised or further interacted or reacted among themselves or with the starting material or primary product, and iii. such mixtures after selective driving-off of relatively volatile components, whether intentional or incidental upon the nature of the reaction.

While the invention is not to be limited by any theoretical discussion as to possible components of such a mixture, the presence of these is believed to be governed by the following considerations:

i. Nicotinic acid or its sodium salt can bring about epoxide ring opening to give an ester, e.g. with propylene oxide:

$$-COOCH_2.CHOH.CH_3$$

In an alkaline medium this would hydrolyze to the nicotinic acid and propane-1,2,-diol. The nicotinic amide would not appear to open an epoxide ring in this way, but may survive unchanged if the molecule reacts elsewhere e.g. at the pyridine nitrogen. However, if the pH is such as to give ammonia from the break-up of the amide group this could react with an alkylene oxide group and given, for instance, alkanolamines such as tripropanolamine.

ii. The primary product appears to be that based on the reaction:

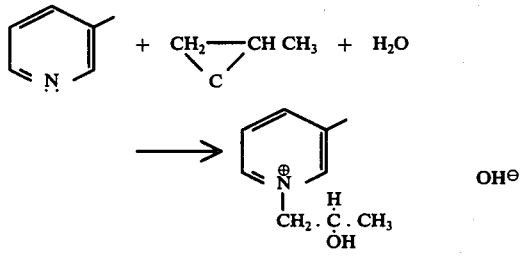

i.e. opening of the epoxide ring by the tertiary nitrogen. At low pH values these are present as quaternary compounds, but at higher pH values, i.e. during the reaction of the present invention, these products decompose, iii. The decomposition reaction appears to take the following course:

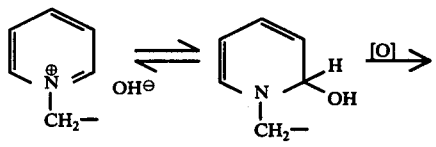

-continued

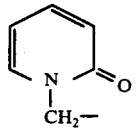

The equilibrium lies to the left, but presence of an oxidising species (e.g. atmosphere oxidation) can form the pyridones as shown.

Thus, in the preferred nicotinamide/propylene oxide reaction the mixture can contain:

i. water ii. unreacted nicotinamide iii. unreacted alkylene oxide iv. propane-1,2-diol v. tripropanolamine vi. as the 'primary product ',

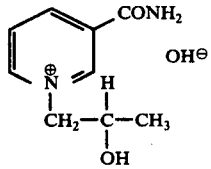

vii. the betaine,

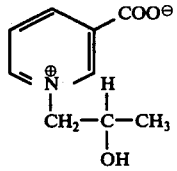

viii. the possible equilibrium form of (vi)

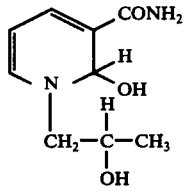

ix. a pyridone formed by oxidation of (viii)

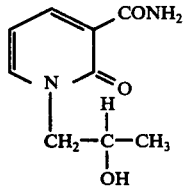

The pyridine ring of this compound could open under alkaline conditions to form an unsaturated amino acid.

x. The compound formed by interaction of the two —OH groups of compound (viii), and of formula:

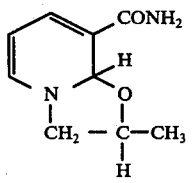

xi. the compound formed as a cyclic form of compound (ix),

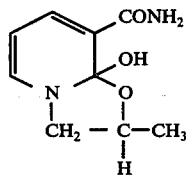

Further reaction of, or interaction between, compounds (i) to (xi) is also possible.

The mixtures defined above may also be used in combination with one or more other such mixture obtained with different reactants and/or under different reaction conditions.

The intended use of a mixture according to the invention is in additives for a zinc and cadmium electroplating baths, and it may be used either as such or further diluted with water. Such an additive, and the eventual bath to be used, preferably also contains an organic polymeric material soluble in water.

Suitable polymers include synthetic polymers such as polyethylene imine, polyvinyl alcohol, polyvinyl pyrrolidone, polyacrylamides and their copolymers with acrylic acid, polyacrylates and cellulose ethers, natural polymers of the polysaccharide type such as gum tragacanth, gum ghattic, gum arabic, agar-agar, algins and starches and also proteinaceous substances such as glue, gelatine, egg albumen and milk, or meat protein hydrolysates.

A readily available polymer is polyvinyl alcohol, which is produced by the complete or partial hydrolysis of polyvinyl acetate in a range of molecular weights. This material may be further modified e.g. by oxidation or by reaction with ethylene oxide. However, a particularly suitable polymer is that made by copolymerising vinyl acetate with from 0 to 50 percent of an unsaturated acid, for example crotonic acid. All these polymers may be used either alone or in combination.

The mixture according to the invention also works well in conjunction with aldehydes that are previously known to have a beneficial brightening effect on zinc and cadmium electrodeposits, such as anisaldehyde, piperonal, vanillin and veratraldehyde.

An electroplating bath containing the additive mixture as described above is a further aspect of the invention. This is usually a zinc or cadmium cyanide plating bath and any conventional composition of such a bath may be used. For example zinc plating baths within the following range of composition have been found valuable, but this range is not limiting upon the broad scope of the invention.

| Bath composition | Concentration |
|---|---|
| | g/l. |
| Zinc | 5 – 45 |

-continued

| Bath composition | Concentration |
|---|---|
| Total cyanide as sodium cyanide | 5 – 130 |
| Sodium hydroxide | 60 – 100 |

However, those skilled in the art will appreciate that not all of the compositions possible from permutating the concentrations of individual constituents given in the above table from satisfactory plating solutions and that it is necessary to maintain a certain proportion between the concentration of the zinc and total cyanide, which are usually present in ratios between 0.3:1 and 0.5:1. A typical zinc plating bath which give satisfactory results with the chemical composition of this invention is given in Example 3.

Representative solutions from cadmium plating baths contain the following range of composition but this range is not limiting upon the broad scope of the invention.

| | g/l |
|---|---|
| Cadmium (as metal) | 15 to 40 |
| Total cyanide (as sodium cyanide) | 70 to 170 |
| Sodium hydroxide | 15 to 60 |

A typical cadmium plating bath which gives satisfactory results with the chemical composition of this invention is given in Example 12.

The mixture remaining after reaction as specified above may be added to an electroplating bath at a concentration within the range 0.1 to 10 g./l., and preferably below 2 g./l., the optimum amount being chosen in dependence upon the alkylene oxide used in the reaction, the presence or not of an organic water soluble polymer, the current density to be employed and the brightness desired on the zinc or cadmium electroplate.

A method of electrodeposition using such a bath is also an aspect of the invention. The pH, current density, and time of plating can follow those conventional in the art. In such baths the temperature is usually somewhat above room temperature e.g. about 85° F, but to improve current efficiency this may go as high as 125° F. Because of these high temperatures the presence of organic polymeric material is advantageous. The electroplating operation may be followed by brief immersion of the plated articles in very dilute acid and/or chromate passivating solutions as mentioned previously.

Articles plated by such a method also fall within the ambit of the present invention.

The invention will be further described with reference to the following examples.

EXAMPLE 1

A typical example of the reaction of a volatile alkylene oxide is the case of propylene oxide reacted with nicotinamide. The procedure is as follows: 1 mole of Nicotinamide is dissolved in 1 liter of water, using gentle heating and stirring. The resultant solution is then allowed to cool to room temperature and then 1 mole of propylene oxide is added. Reaction occurs slowly at first but accelerates, its rate being observed by the rise in temperature of pH. When the temperature has reached a maximum value the time is noted and after one hour (to allow all secondary reactions to be completed) the mixture is then cooled and the pH adjusted to be approximately neutral with concentrated hydrochloric acid to prevent further secondary reactions. The solution may then be diluted to a convenient strength for addition to the plating solution.

EXAMPLE 2

A typical example of the reaction of a non-volatile alkylene oxide is the reaction between styrene oxide and nicotinamide. In this case one mole of nicotinamide is dissolved in 200 ml of water, 50 ml of ethanol and 0.75 mole of styrene oxide introduced and the mixture refluxed for three hours. At the end of this time the reaction mixture is poured into 200 ml of ethanol and the pH adjusted to be approximately neutral with concentrated hydrochloric acid and the solution then further diluted with ethanol, if desired, to a convenient strength suitable for addition to the plating solution.

EXAMPLE 3 — Electroplating

An alkaline zinc cyanide plating bath was made up so as to contain 40 g./l. of zinc, 115 g./l. of total cyanide (measured as sodium cyanide) and 77.5 g./l. of sodium hydroxide. 267 ml. of this solution were placed in a standard Hull cell. A volume equivalent to 0.6 ml/l of the mixture made as described in Example 1 were added. Zinc was electrodeposited on a steel Hull cell panel for 10 minutes at a temperature of 85° F and a current of 2 A. The panel was removed, rinsed under running tap water, partially immersed for 10 seconds in a 0.25% v/v aqueous solution of concentrated nitric acid (so as to provide a subsequent comparison between dipped and undipped portions of the panel), rinsed again under running tap water and dried in warm air to avoid drying stains.

The zinc deposit was uniform and bright over effective current densities from 10 A/dm$^2$ to 0.4 A/dm$^2$, while the dipped portion was increased in brightness.

EXAMPLE 4 — Electroplating

The method of Example 3 was repeated, using 0.4 ml/l of the reaction mixture of Example 1 and with the addition of 0.3 ml/l of a 10% aqueous solution of polyvinyl acetate copolymerised with about 10% crotonic acid to the Hull cell.

Closely similar results were obtained with bright plate ranging from the high current density edge of the panel down to about 0.2 A/dm$^2$.

EXAMPLE 5 — Electroplating

The method of Example 4 was repeated with the addition of 0.1 g/l of polymerised polyvinyl alcohol and 0.2 ml/l of 10% aqueous polyvinyl acetate crotonic acid copolymer as described in Example 4.

An improvement in brightness on the panel was observed, from the high current density edge to the low current density edge.

EXAMPLE 6 — Electroplating

The method of Example 3 was repeated except that 0.8 ml/l of the mixture obtained by reacting nicotinamide and styrene oxide as in Example 2 and 0.1 g/l of polymerised polyvinyl alcohol were used as additives.

A bright zinc plate was achieved from the high current density edge down to 0.25 A/dm$^2$, and the acid dipped portion showed a considerable increase in brightness.

EXAMPLE 7 — Electroplating

The method of Example 3 was repeated for a number of tests giving approximately equivalent brightnesses on the plates in each case and so providing a comparison between the additives. The additives, which were used in the aqueous reaction mixture, were as follows Mixture after reaction of:

| | Amount in ml/l used of aqueous reaction mixture. |
|---|---|
| (a) Nicotinamide/butylene oxide | 0.5 |
| (b) Nicotinamide/propylene oxide (2 mols) | 0.7 |
| (c) Nicotinamide/styrene oxide | 0.5 |
| (d) Sodium nicotinate/butylene oxide | 1.3 |
| (e) Sodium nicotinate/styrene oxide | 0.8 |
| (f) (a) and (c) combined | 0.2 + 0.1 respectively. |

EXAMPLE 8 — Electroplating

The method of Example 3 was repeated using 0.6 ml/l of the reaction mixture, as described in Example 1, and with the addition of 0.3 ml/l of a 30% aqueous solution of ammonium polyacrylate. Similar results were obtained on the plate with the bright plating range extending from the high current density edge of the panel down to about 0.2 A/dm$^2$.

EXAMPLE 9 — Electroplating

The method of Example 8 was repeated using 0.4 ml/l of the reaction mixture described in Example 1, with the addition of 0.3 g/l of carboxymethyl cellulose. Bright plate was obtained extending from the high current density edge down to about 0.1 A/dm$^2$.

EXAMPLE 10 — Electroplating

The method of Example 3 was repeated using 0.1 ml/l of the reaction mixture described in Example 2, and with the addition of 0.2 g/l of hydroxyethylcellulose and 0.3 g/l of vanillin. Bright plate was obtained extending from the high current density edge down to about 0.3 A/dm$^2$.

EXAMPLE 11 — Electroplating

The method of Example 3 was repeated using 0.2 ml/l of the reaction mixture described in Example 1, with the addition of 0.1 g/l of anisaldehyde, 0.4 ml/l of 30% ammonium polyacrylate solution and 0.3 g/l of carboxymethyl cellulose. Bright plate was obtained extending from the high current density edge down to about 0.1 A/dm$^2$.

EXAMPLE 12 — Electroplating

An alkaline cadmium cyanide plating bath was made up to contain 20 g/l of cadmium, 130 g/l of total cyanide (measured as sodium cyanide) and 27 g/l of sodium hydroxide. 267 ml of this solution were placed in a standard Hull cell. To this were added quantities of materials to give the concentrations 0.3 ml/l of the reaction mixture described in Example 2, 0.2 ml/l of a 30% aqueous solution of ammonium polyacrylate, 0.6 g/l of hydroxyethylcellulose and 0.75 g/l of nickel sulphate hexahydrate. Cadmium was electrodeposited on a stell Hull cell panel for 10 minutes at a temperature of 85° F and at a current of 2 A. The panel was removed, rinsed under running tap-water, partially immersed for 10 seconds in a 2% v/v solution of concentrated sulphuric acid also containing hydrogen peroxide (so as to provide a subsequent comparison between dipped and undipped portions of the panel), rinsed again in running tapwater and dried in warm air to avoid drying stains.

The cadmium deposit, after bright dipping, was uniform and bright from an effective current density of 5 A/dm$^2$ to the low current density edge of the panel.

EXAMPLE 13 — Electroplating

The method of Example 12 was repeated except that the additives were 0.6 ml/l of the reaction mixture described in Example 1, 0.3 ml/l of a 30% aqueous solution of ammonium polyacrylate, 0.2 ml/l of a 10% aqueous solution of polyvinyl alcohol/crotonic acid copolymer and 0.75 g/l of nickel sulphate hexahydrate. The cadmium deposit, after bright dipping, was uniform and bright from an effective current density of 10 A/dm$^2$ to the low current density edge of the panel.

We claim:

1. In a process for electroplating zinc or cadmium from an aqueous bath, the improvement comprising employing as a brightening additive an effective brightening amount of a mixture produced by reaction in a liquid media selected from the group consisting of water and short-chain aliphatic alcohols and mixtures thereof of:

a. a substituted pyridine in which the pyridine is substituted only with at least one member selected from the group consisting of cyano, alkyl, hydroxy, carboxy and carboxy salts with ammonia, amines and Groups I and II metals, —CONR$^1$R$^2$ wherein R$^1$ and R$^2$ are individually selected from the group consisting of hydrogen, alkyl, and phenyl; and COOR$^3$; wherein R$^3$ is selected from the group consisting of alkyl, benzyl and phenyl; and b. an oxirane of the formula

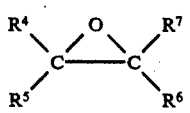

wherein R$^4$, R$^5$, R$^6$ and R$^7$ are each selected from the group consisting of hydrogen, alkyl, and alkyl and alkenyl interrupted by an ether linkage, and phenyl;

the molar ratio of component (a) to component (b) being from 2:1 to 1:2.

2. The process of claim 1 wherein the mixture is employed in an amount from 0.1 to 10 gms. per liter.

3. The process according to claim 1 wherein component (a) is selected from the group consisting of 2,6-lutidine, 3-cyanopyridine, 3-hydroxypyridine, nicotinic acid, 2-picolinic acid, nicotinamide, N,N-diethylnicotinamide, methyl nicotinate, benzyl nicotinate and phenyl nicotinate.

4. The process according to claim 1 wherein component (b) is selected from the group consisting of ethylene oxide, propylene oxide, butylene oxide, styrene oxide, butyl glycidyl ether and alkyl glycidyl ether.

5. The process according to claim 1 wherein component (a) is nicotinamide and component (b) is propylene oxide.

6. The process according to claim 1 wherein the molar ratio of component (a) to component (b) is from 1:0.8 to 1:1.25.

7. The process according to claim 1 wherein at least two different products formed by reaction between a component (a) and a component (b) are used together as brightening additives.

8. The process according to claim 1 wherein the brightening additive is used in conjunction with at least one further additive selected from the group consisting of a synthetic polymer, a naturally occurring polysaccharide polymer, a proteinaceous substance and an aldehyde brightener.

9. In an aqueous plating bath for the electroplating of zinc or cadmium including an effective amount of brightening additive, the improvement comprising:

said brightening additive being a mixture produced by reaction in a liquid media selected from the group consisting of water and short-chain aliphatic alcohols and mixtures thereof of a. a substituted pyridine in which the pyridine is substituted only with at least one member selected from the group consisting of cyano, alkyl, hydroxy, carboxy and carboxy salts with ammonia, amines and Groups I and II metals, —CONR$^1$R$^2$ wherein R$^1$ and R$^2$ are individually selected from the group consisting of hydrogen, alkyl, and phenyl; and COOR$^3$, wherein R$^3$ is selected from the group consisting of alkyl, benzyl and phenyl; and b. an oxirane of the formula

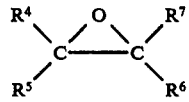

wherein R$^4$, R$^5$, R$^6$ and R$^7$ are each selected from the group consisting of hydrogen, alkyl, alkenyl, alkyl and alkenyl interrupted by an ether linkage, and phenyl;

the molar ratio of component (a) to component (b) being from 2:1 to 1:2.

10. The plating bath of claim 9 wherein the mixture is employed in an amount from 0.1 to 10 gms. per liter.

11. The plating bath of claim 9 wherein the plating bath is a cyanide bath for the plating of zinc.

12. The plating bath of claim 9 wherein the bath is a cyanide bath for the plating of cadmium.

13. A brightening additive composition for the plating of zinc or cadmium comprising.

A. a brightening additive selected from the group consisting of a synthetic polymer, a naturally occurring polysaccharide polymer, a proteinaceous substance and an aldehyde brightener; and B. a mixture produced by reaction in a liquid media selected from the group consisting of water and short-chain aliphatic alcohols and mixtures thereof of a. a substituted pyridine in which the pyridine is substituted only with at least one member selected from the group consisting of cyano, alkyl, hydroxy, carboxy and carboxy salts with ammonia, amines and Groups I and II metals, —CONR$^1$R$^2$ wherein R$^1$ and R$^2$ are individually selected from the group consisting of hydrogen, alkyl, and phenyl; and COOR$^3$, wherein R$^3$is selected from the group consisting of alkyl, benzyl and phenyl; and b. an oxirane of the formula
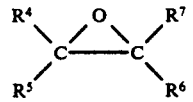
wherein $R^4$, $R^5$, $R^6$ and $R^7$ are each selected from the group consisting of hydrogen, alkyl, alkenyl, alkyl and alkenyl interrupted by an ether linkage, and phenyl;
the molar ratio of component (a) to component (b) being from 2:1 to 1:2.
* * * * *